US008141492B1

(12) United States Patent
Ambs

(10) Patent No.: US 8,141,492 B1
(45) Date of Patent: Mar. 27, 2012

(54) INSULATED SECONDARY CHARGES

(75) Inventor: Jonathan Gentry Ambs, Fairfax, VA (US)

(73) Assignee: Jonathan G. Ambs, Jonesboro, AR (US)

( * ) Notice: Subject to any disclaimer, the term of this patent is extended or adjusted under 35 U.S.C. 154(b) by 171 days.

(21) Appl. No.: 12/387,735

(22) Filed: May 7, 2009

Related U.S. Application Data

(60) Provisional application No. 61/053,621, filed on May 15, 2008.

(51) Int. Cl.
*F42B 5/02* (2006.01)

(52) U.S. Cl. ..... 102/430; 102/438; 102/480

(58) Field of Classification Search ..... 102/430, 102/438, 480
See application file for complete search history.

(56) References Cited

U.S. PATENT DOCUMENTS

| | | | | | |
|---|---|---|---|---|---|
| 3,916,792 | A | * | 11/1975 | Elmore et al. | 102/431 |
| 4,341,147 | A | * | 7/1982 | Mayer | 89/7 |
| 4,531,458 | A | * | 7/1985 | Saxby | 102/440 |
| 4,803,927 | A | * | 2/1989 | Washburn | 102/434 |
| 4,852,458 | A | | 8/1989 | Bulman | |
| 4,907,510 | A | * | 3/1990 | Martwick et al. | 102/434 |
| 4,930,421 | A | | 6/1990 | Macdonald | |
| 4,972,777 | A | * | 11/1990 | Algera | 102/430 |
| 5,029,530 | A | * | 7/1991 | Martwick et al. | 102/434 |
| 5,048,423 | A | * | 9/1991 | Garrett | 102/434 |
| 5,067,408 | A | * | 11/1991 | Martwick | 102/434 |
| 5,069,137 | A | * | 12/1991 | Martwick | 102/434 |
| 5,388,522 | A | * | 2/1995 | Martwick et al. | 102/434 |
| 6,422,149 | B1 | * | 7/2002 | Saxby | 102/446 |
| 7,707,940 | B2 | * | 5/2010 | Lebacher | 102/434 |
| 7,707,941 | B2 | * | 5/2010 | Bishop et al. | 102/438 |

* cited by examiner

*Primary Examiner* — Michael David

(57) ABSTRACT

A means of increasing the velocity of projectiles using multiple charges ignited at different times to facilitate a sustained pressure pulse in the barrel is provided. The propellant charges are separated with one or more rigid barriers and ignited in series; igniting the propellant nearest to the projectile first and the propellant that is farthest from the propellant last. By timing the ignition of the charges a higher average pressure is sustained in the gun tube without risking a breach blow. After the peak pressure of the first propellant charge is reached the second propellant is ignited. The energy of the second propellant causes the pressure in the gun tube to fall more gradually. Thus the average pressure that acts on the projectile is safely increased. The following includes several methods of accomplishing this.

11 Claims, 6 Drawing Sheets

INSULATED SECONDARY CHARGES

CROSS-REFERENCE TO RELATED APPLICATIONS

This application claims the benefits of provisional patent application Ser. No. 61/053,621, filed 2008 May 15 by the present inventor.

FEDERALLY SPONSORED RESEARCH

Not Applicable

SEQUENCE LISTING OR PROGRAM

Not Applicable

BACKGROUND

1. Field

This application relates to the use of multiple charges to accelerate a projectile forward.

2. Detailed Description

Another way of explaining the traveling charge is as follows with four assumptions. The first assumption is that the barrier between two propellants (3) in FIG. 1 has no bore resistance. The second assumption is that the barrier creates a perfect seal between the first charge (4) and the traveling charge (2). The third assumption is that the propellant in the base charge (4) has the same mass as the propellant in the traveling charge (2). The fourth assumption is that both propellants have an identical burn rate.

Figure 12:
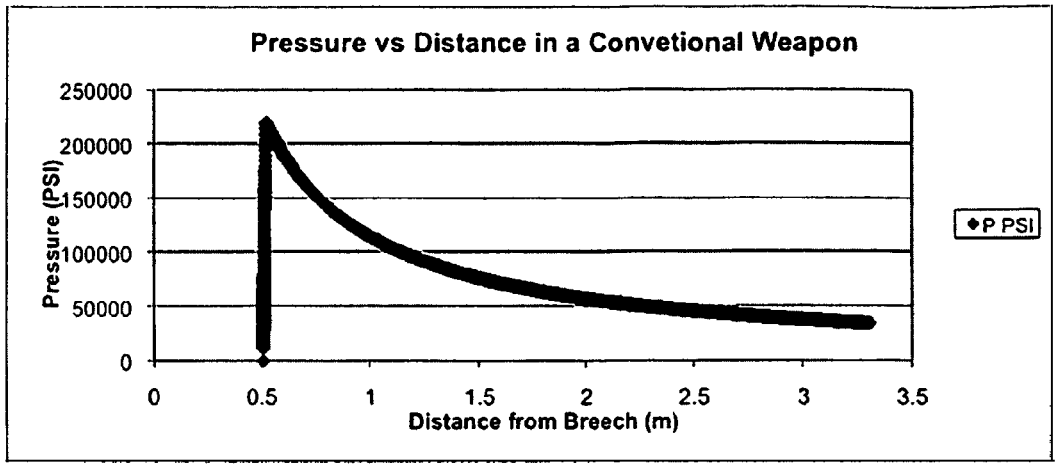

If the base charge is the only charge ignited the pressure inside the chamber is illustrated in FIG. 12. Initially the base charge is a solid, but as the base charge burns it creates gas and heat, which increases the pressure. The ideal gas law states that PV=nRT. This can be rewritten that P=nRTN: P is pressure, n is the number of moles of gas, R is the universal gas constant, T is the temperature of the Kelvin, and V is the volume of the container. (The temperature cannot be increased beyond the burn temperature of the propellant, and the volume is increasing as the projectile travels down the bore, and the value n is increasing as long as the propellant is burning.) After a certain point, the rate of gas produced by the base charge is less than the rate of volume increase, which causes the pressure to decrease.

Figure 13:
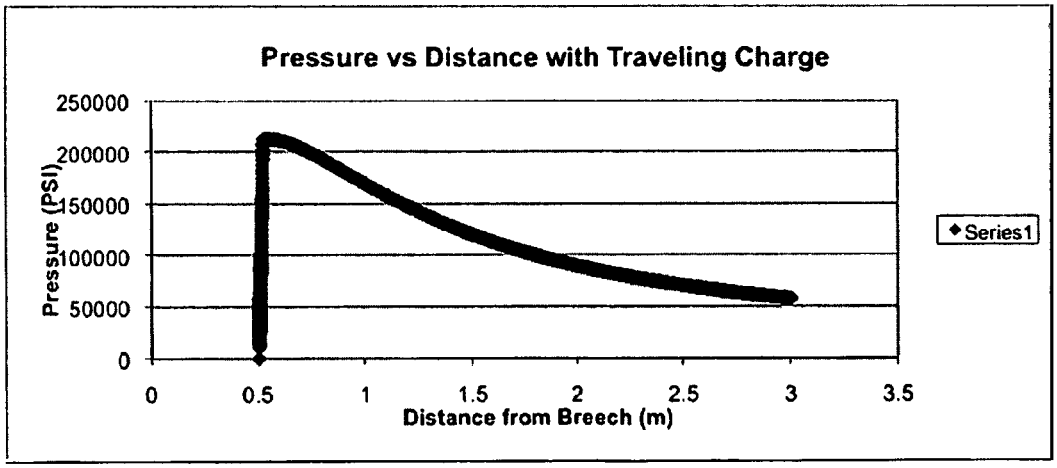

When the traveling charge is ignited, it produces another pressure wave pushing the projectile forward and the barrier back toward the breech end of the gun tube. This causes the volume between the barrier and the breach to decrease, which causes the pressure between the breech and barrier to increase. The increase in pressure allows the traveling charge to exert a greater average pressure on the projectile, which gives the projectile a higher muzzle velocity as shown in FIG. 13.

In this scenario the peak pressure inside the breech does not increase, but the average gas pressure in the gun tube is higher than with a single charge. The work done by the gas is equal to average pressure multiplied by the area of the base multiplied by the length of the gun tube. By increasing the average pressure, you increase the work done by the gas. The work of the gas is proportional to the mass times the velocity squared. Because of this a higher muzzle velocity is obtained.

Between the late 1940's and the late 1980's experiments were done trying to implement this technique, but none of them were successful. Due to the conditions inside the breech, the traveling charge experienced high pressure and temperature. This often caused the traveling charge to ignite prematurely. Premature ignition of the traveling charge led to excessive pressures in the gun tube resulting in breach blows or unpredictability in the muzzle velocity. Additionally, grain fracturing occurred. Due to the greater surface area created by the grain fracturing, the burn rate of the propellant increases. Since the degree of grain fracturing varied, the new burn time and the resulting exit velocity of the projectile was unpredictable. Even though the traveling charge increased the average pressure, it could not be utilized because of the lost control of the muzzle velocity and the danger of breech blows.

The difficulties of the traveling charge concept described above is overcome by the present invention. The unpredictability of the ignition time and burn rate of the charges is solved by insulating the booster charge from the effects of the base charge. For example, you could ignite the propellant closest to the projectile, called the base charge, first and then ignite the propellant nearest to the breech, called the booster charge. The barrier separating the two charges is structurally supported against the breech end of the gun tube. The barrier and related structural members isolate the booster charge form the pressures of the gas generated by ignition of the base charge. This is illustrated in FIG. 2 through FIG. 11. Upon ignition of the base charge, the projectile will be accelerated forward, increasing the volume between the barrier and the projectile.

Figure 5:
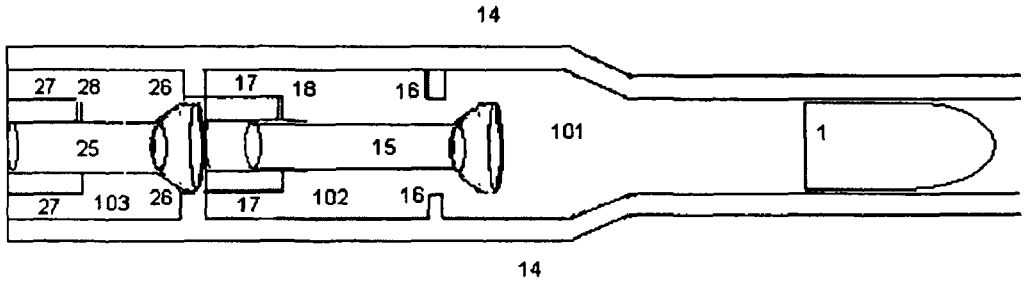
Figure 6:
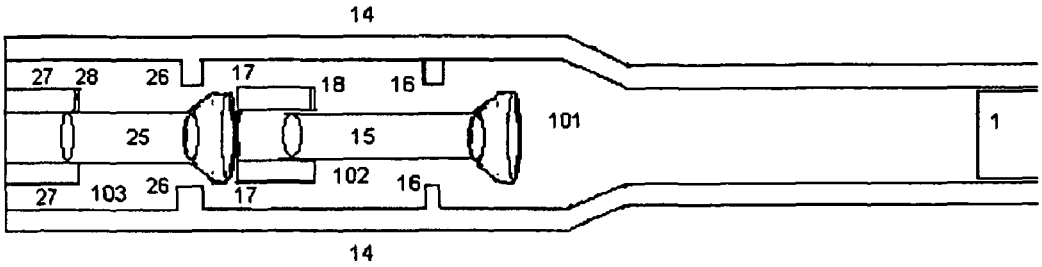
Figure 7:
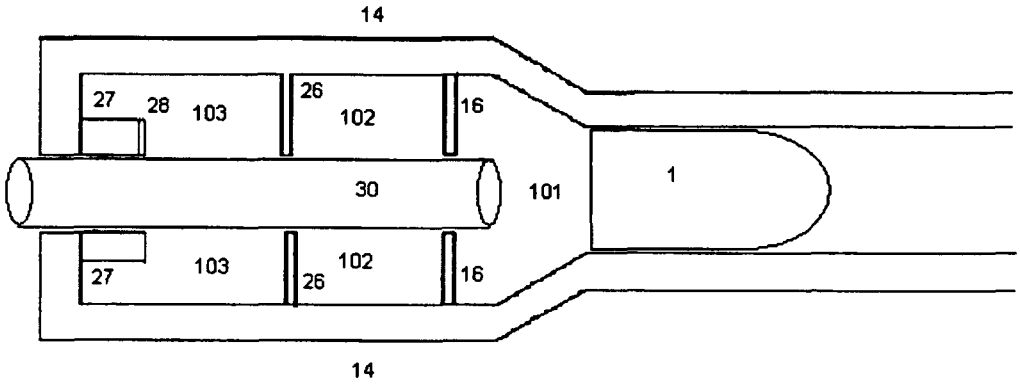
Figure 8:
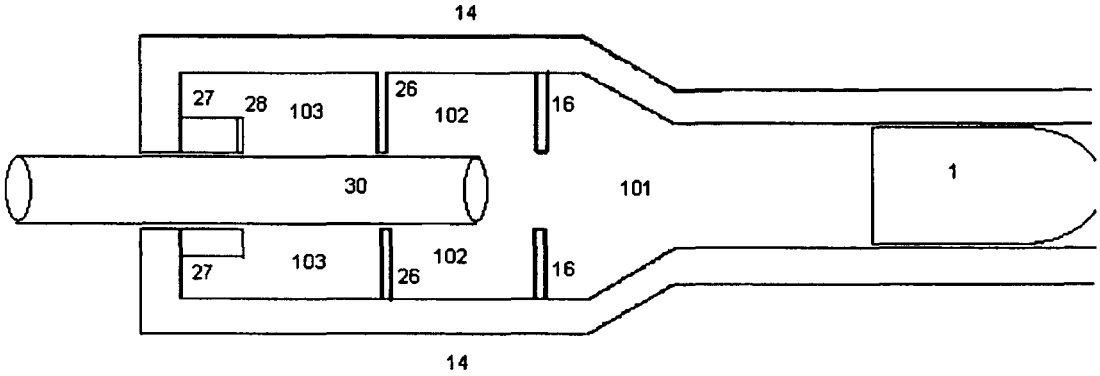
Figure 9:
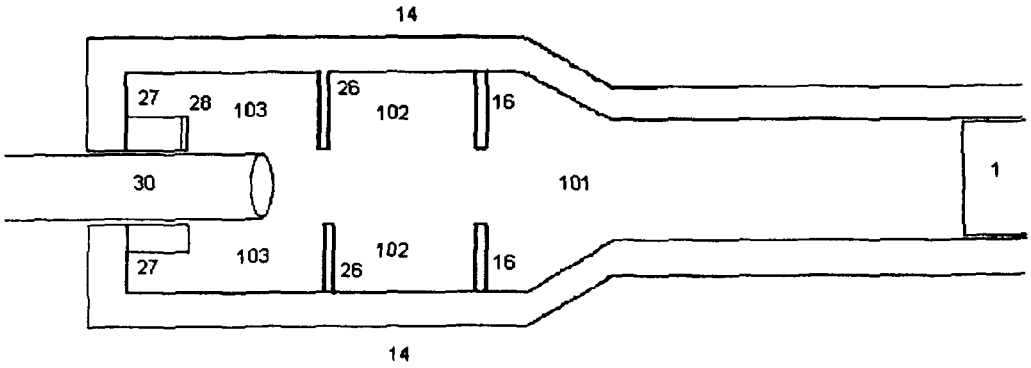

When the barrier is opened, either through the one-way valve as in FIG. 2-FIG. 6 or a piston action as in FIGS. 7-9, the gas from the booster charge will combine with the gas from the base charge. This allows the average pressure to increase without surpassing the peak pressure that the breech can withstand, and will increase the maximum velocity of an artillery piece. This will result in the following pressure vs. distance-traveled diagram shown in FIG. 14.

The use of a one-way valve or piston produces an Insulated Secondary Ballistic Charges that yields the same benefits as the traveling charge effect while also eliminating the problems experienced in a traveling charge. Since the barrier is mechanically supported, an effective seal can be created between the first and the second charge, and the base charge will not damage the booster charge. This will eliminate the risk or pre-mature ignition and grain fracturing due to the increase in temperature and pressure.

DRAWINGS

Figures

Figure 1:
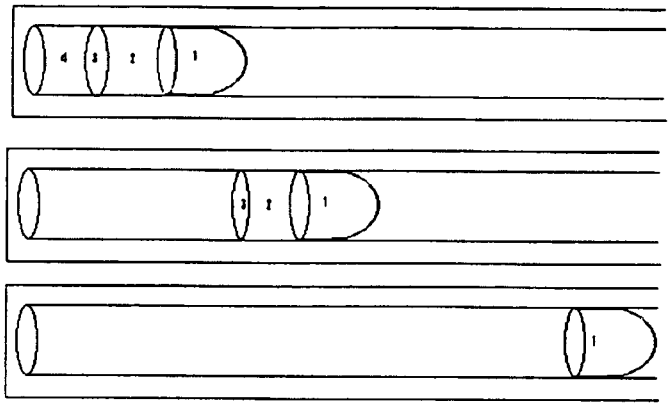
Figure 1 PRIOR ART

FIG. 1. Illustrates of the traveling charge configuration described by Langweiler and covered by U.S. Pat. No. 4,930,421.

Figure 2:
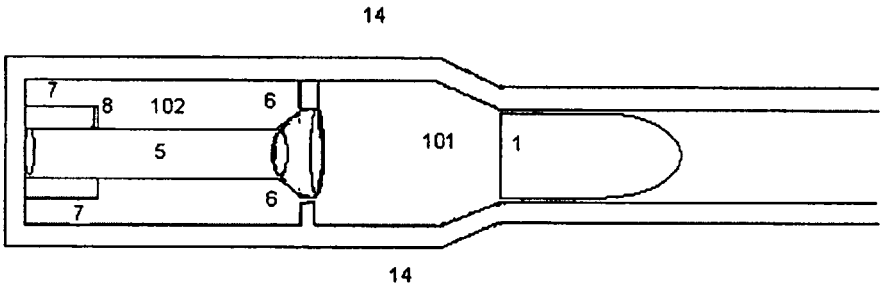

FIG. 2. Illustrates a barrier in the form of a single one-way valve in the closed position.

Figure 3:
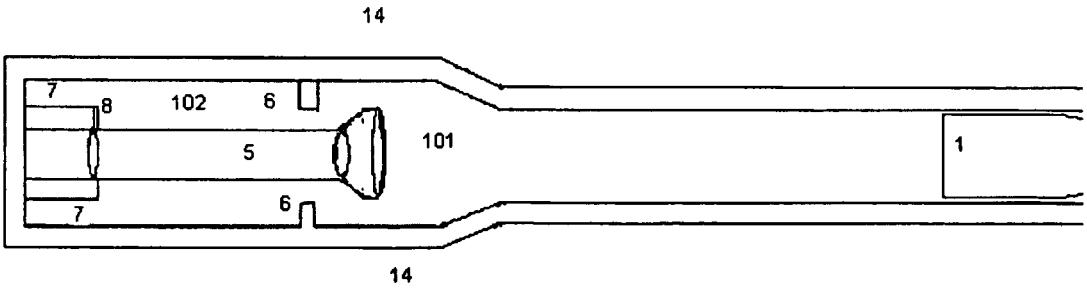

FIG. 3. Illustrates a barrier in the form of a single one-way valve in the open position.

Figure 4:
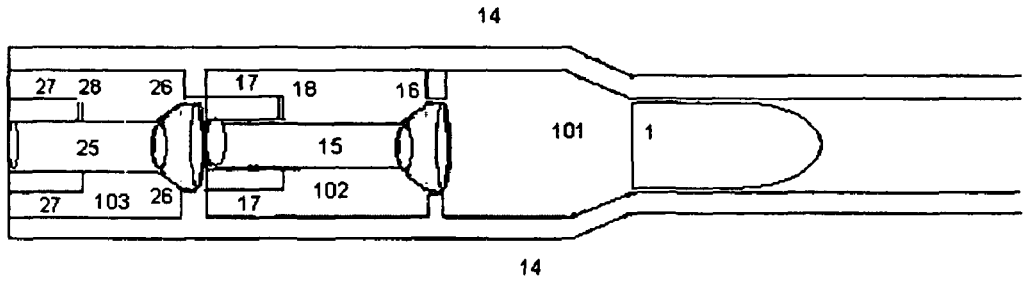

FIG. 4. Illustrates a system with multiple one-way valves with all valves in the closed position.

FIG. 5. Illustrates a system with multiple one-way valves with one valve in the open position.

FIG. 6. Illustrates a system with multiple one-way valves with all valves in the open position.

FIG. 7. Illustrates a multi unit system with a piston that acts as the valve with all the valves shut.

FIG. 8. Illustrates a multi unit system with a piston that acts as the valve with one valve open.

FIG. 9. Illustrates a multi unit system with a piston that acts as the valve with both valves open.

Figure 10:
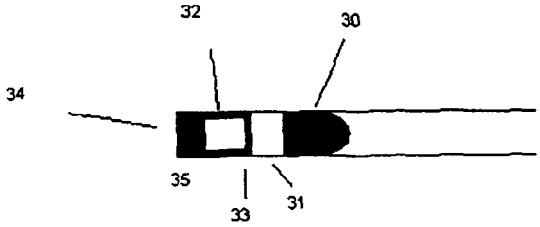

FIG. 10. Illustrates this concept using a support structure to isolate the base charge from the effects of the forward propellant.

Figure 11:
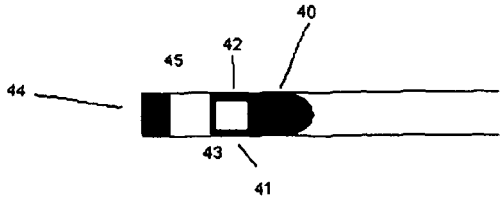

FIG. 11. Illustrates this concept using a support structure to isolate the traveling charge from the effects of the initial propellant.

FIG. 12. Illustrates the pressure inside the chamber if the base charge is the only charge ignited.

FIG. 13. Illustrates the pressure inside the gun's chamber if the traveling charge is ignited 0.001 seconds after the base charge.

Figure 14:
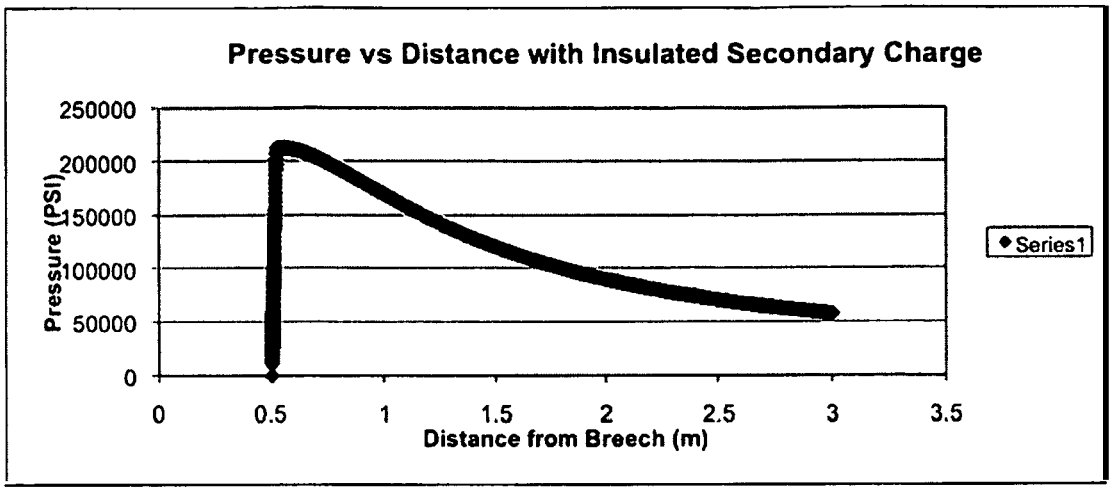

FIG. 14. Illustrates the pressure curve inside the gun's chamber with an insulated secondary charge is similar to the pressure curve obtained by a traveling charge.

DETAILED DESCRIPTIONS

FIG. 1 represents the original concept of the traveling charge envisioned by Langweiler. The projectile (1) sits on top of two or more charges. The charge closest to the breech of the gun (4) is ignited first, accelerating the projectile (1) the second charge (2) and the barrier (3). When the peak pressure has been reached the second charge (2) will ignite. The kinetic energy imparted to the second charge (2) by the first charge (4) will be transferred to the projectile (1). This will lead to a higher muzzle velocity.

FIG. 2 represents a configuration of a single valve in the closed position and FIG. 3 represents a single valve in the open position. In this model, the gun barrel and breech (14) surrounds the base charge (101) and the booster charge (102). The base charge (101) is placed between the projectile (1) and the one-way valve and barrier (5) and (6) respectively. The booster charge (102) would be placed behind the barrier and in front of the breech. The base charge (101) is ignited first. As the projectile (1) moves forward, the pressure in the base charge's (101) chamber will fall. As this occurs, the booster charge (102) will be ignited creating a higher pressure in the volume containing the base charge (102) causing the one-way valve (5) to open. A mechanical stop (8) will prevent the one-way valve from being fired out of the weapon. Once the projectile leaves the gun, the pressure will return to normal, and the one-way valve (5) will be guided back to its original position by rails provided on the interior (7).

FIG. 4 represents multiple valves in the closed position, FIG. 5 represents one valve in the open position, and FIG. 6 represents both valves in the open position. The gun barrel and breech (14) surrounds the base charge (101) and the booster charges (102 and 103). The base charge (101) would be placed between the projectile (1) and the barrier and the valve (15 and 16). The booster charges (102 and 103) would be placed is volumes (102) and (103).

The base charge (101) would ignite first. As the projectile (1) moves forward, the pressure in the base charge's (101) chamber will fall. As this occurs, the booster charge (102) will be ignited creating a higher pressure in the volume containing the base charge (102) causing the one-way valve (15) to open. As the projectile (1) moves farther forward, the pressure in the volumes 101 and 102 will fall. As this occurs, the booster charge (103) will be ignited creating a higher pressure in the volume containing the base charge (103) causing the one-way valve (25) to open. A mechanical stop (28) will prevent the one-way valve from being fired out of the weapon. Once the projectile leaves the gun, the pressure will return to normal, and the one-way valves (15 and 25) will be guided back to its original position by rails on the interior (17 and 27).

FIG. 7, FIG. 8, and FIG. 9 demonstrate another method of achieving this with a piston that is pushed towards the breech when the pressure in the gun tube is greater than the pressure on the piston. FIG. 7 represents multiple valves in the closed position, FIG. 8 represents one valve in the open position, and FIG. 9 represents both valves in the open position. The gun barrel and breech (14) surrounds the base charge and the booster charges. The base charge (101) would be placed between the projectile (1) and the barriers (16 and 30). The booster charges (102 103) would be placed behind the first barrier (16) and the second barrier (26) respectively. The base charge (101) would be ignited first forcing the piston towards the breech.

As the projectile (1) moves forward, the pressure in the chamber of the base charge will push the piston (30) towards the breach, opening the barriers in sequence (16 first followed by 26). The heat and pressure from the base charge will ignite the booster charge when the piston (30) crosses the barrier (16 first followed by 26). The booster charge closest to the base charge (102) would be ignited before the booster charge (103) was ignited. The pressure will continue to press the rod backwards, igniting the second booster charge. A brake (28) will stop the piston (30) from being fired out of the back of the weapon. Once the projectile leaves the gun, the pressure will return to normal, and the piston will be guided back to its original position by rails (27).

FIG. 10 represents accomplishing this concept with a barrier (33) that separates the base charge (31) and the booster charge (35). After ignition of the base charge (31) the support structure (32) will protect the booster charge from premature ignition or grain fracturing. When the booster charge (35) is ignited, it will force the barrier (31) forward. This will compress the gas produced by the propellant in the base charge.

Another method of doing this is by insulating the traveling charge with a barrier and a support structure. This method is illustrated in FIG. 11. In this figure, the base charge (45) is fired first and it accelerates the booster charge (41) the support structure (42) and the barrier (43). After the peak pressure from the base charge (45) is experienced the booster charge is ignited. Since the traveling charge is protected by a barrier and support structure, grain fracturing and premature ignition will not occur.

FIGS. 12 through 14 are graphs representing a mathematical model calculated from equations found in the "Theory of the Interior Ballistics of Guns" by John Corner. FIG. 12 is a graph that illustrates the pressure inside the gun's chamber compared to the position of the projectile in the chamber when no traveling charge or insulated barriers are present. FIG. 13 is a graph that shows the calculated pressure curve inside the gun's chamber compared to the position of the projectile in the chamber when a traveling charge is utilized successfully. FIG. 14 is a graph that shows the calculated pressure curve when an insulated secondary charge is used. As can be observed here, the benefits of the traveling charge are preserved.

I claim:

1. A projectile propulsion system comprising:

a. a gun tube with an open muzzle end and a closed breech end;

b. a projectile;

c. one base charge adjacent to the projectile;

d. at least one booster charge;

e. at least one rigid mechanical barrier separating the booster charge and the base charge configured to provide pressure and heat isolation between adjacent charges;

wherein said rigid mechanical barrier is configured to act as a rigid support and to protect the at least one of said booster charges from crushing forces; and f. at least one piston that is configured to act as a valve between the charges by sliding in an axial direction and wherein the piston is slidingly attached to a support structure that is located at the breech end.

2. A projectile propulsion system as set forth in claim 1 wherein the piston is configured to slide in an axial direction toward the breech when the pressure inside the breech is greater than the pressure outside the breech.

3. A projectile propulsion system as set forth in claim 1 wherein the at least one rigid mechanical barrier is rigidly attached to the gun tube and configured to insulate the at least one booster charge from the base charge's pressure when the base charge is ignited.

4. A projectile propulsion system as set forth in claim 1 wherein the piston is configured to be accelerated by the base charge providing a means for the booster charge to act as a traveling charge to further accelerate the projectile.

5. A projectile propulsion system as set forth in claim 1, comprising a mechanical means of limiting the motion of the piston to limit the axial excursion of the piston in the gun tube.

6. A projectile propulsion system as set forth in claim 1, wherein the system is configured to control the movement of the piston towards the breech so that an ignition time of the booster charge may be controlled.

7. A projectile propulsion system as set forth in claim 1, further comprising at least two booster charges and at least two rigid mechanical barriers.

8. A projectile propulsion system as set forth in claim 1, further comprising one or more additional booster charges disposed breech ward of the said at least one booster charge each separated by barriers.

9. A projectile propulsion system as set forth in claim 1, further comprising a firing order in which the base charge is initiated before any of the other charges, and in which at least one booster charge is initiated after the said base charge.

10. A projectile propulsion system as set forth in claim 1, wherein the system is further configured to integrate the projectile, the at least one booster charge, base charge, the at least one mechanical barrier, the support structure and an initiation system into one assembly to facilitate insertion of the assembly into a gun tube.

11. A projectile propulsion system as set forth in claim 1 wherein the piston is configured to translate in an axial direction toward the muzzle when the pressure in the booster charge volume is greater than the pressure in the base charge volume, or towards the breach when the pressures are in equilibrium.

* * * * *